US006669210B2

(12) United States Patent
Chen

(10) Patent No.: US 6,669,210 B2
(45) Date of Patent: Dec. 30, 2003

(54) ADJUSTABLE ICE SKATE

(75) Inventor: Henry T. Chen, Taipei (TW)

(73) Assignee: Minson Enterprises Co., Ltd., Taipei (TW)

( * ) Notice: Subject to any disclaimer, the term of this patent is extended or adjusted under 35 U.S.C. 154(b) by 0 days.

(21) Appl. No.: 10/004,163

(22) Filed: Oct. 30, 2001

(65) Prior Publication Data

US 2002/0041073 A1 Apr. 11, 2002

Related U.S. Application Data

(63) Continuation-in-part of application No. 09/833,758, filed on Apr. 12, 2001, now abandoned, which is a continuation of application No. 09/141,170, filed on Aug. 27, 1998, now Pat. No. 6,217,039.

(60) Provisional application No. 60/073,464, filed on Feb. 2, 1998.

(51) Int. Cl.[7] ..... A63C 1/26

(52) U.S. Cl. ..... 280/11.16; 230/11.26

(58) Field of Search ..... 280/11.12, 11.16, 280/11.26, 11.3, 11.32; 36/97

(56) References Cited

U.S. PATENT DOCUMENTS

| | | | | | |
|---|---|---|---|---|---|
| 3,007,706 | A | * | 11/1961 | Pullen | 280/11.26 |
| 3,993,318 | A | * | 11/1976 | Rothmayer | 280/11.26 |
| 4,262,918 | A | * | 4/1981 | Sandino | 280/11.26 |
| 5,634,648 | A | * | 6/1997 | Tonel et al. | 280/11.27 |
| 5,645,288 | A | * | 7/1997 | Lu | 280/11.26 |
| 5,836,592 | A | * | 11/1998 | Chang | 280/11.26 |
| 5,890,723 | A | * | 4/1999 | Benoit | 280/11.27 |
| 6,015,157 | A | * | 1/2000 | Hilgarth | 280/11.27 |
| 6,045,143 | A | * | 4/2000 | Wrike | 280/11.27 |

FOREIGN PATENT DOCUMENTS

| | | | | |
|---|---|---|---|---|
| AU | 268424 | * | 7/1965 | 280/11.26 |
| FR | 2332040 | * | 6/1977 | 280/11.26 |
| FR | 2584936 | * | 1/1987 | 280/11.26 |
| FR | 2658731 | * | 8/1991 | 280/11.26 |
| NL | 8800917 | * | 8/1988 | 280/11.16 |

* cited by examiner

*Primary Examiner*—Frank Bennett Vanaman
(74) *Attorney, Agent, or Firm*—Westman, Champlin & Kelly, P.A.

(57) ABSTRACT

An ice skate comprising a boot modifiable in length disposed on a blade holder frame, and a locking mechanism. The blade holder frame includes a recessed surface disposed on a forward section of the blade holder frame longitudinally along a longitudinal axis of the skate. The boot includes a heel portion disposed on the blade holder frame and a toe box portion slidable on the blade holder frame. The toe box portion includes a first slot disposed longitudinally along the longitudinal axis of the skate, a perimeter wall extending downward from the first slot, and downwardly extending channel walls. The perimeter wall seats within the recessed forward surface of the blade holder frame to securably guide the toe box rearwardly or forwardly. The locking mechanism includes first and second detents disposed on the downwardly extending channel walls engaging a plurality of indentations disposed on the forward section of the blade holder frame.

28 Claims, 5 Drawing Sheets

ADJUSTABLE ICE SKATE

CROSS-REFERENCE TO RELATED APPLICATION(S)

This application is a continuation-in-part of application Ser. No. 09/833,758 now abandoned; filed Apr. 12, 2001, which is a continuation of application Ser. No. 09/141,170; filed Aug. 27, 1998; U.S. Pat. No. 6,217,039, which claims priority of U.S. Provisional Application No. 60/073,464; filed Feb. 2, 1998, entitled "ADJUSTABLE SKATE".

BACKGROUND OF THE INVENTION

The present invention relates to ice skates, and in particular to ice skates wherein the boot size is adjustable to accommodate different foot sizes.

Ice skating has been a popular recreational activity for many years, especially for children. However, children have growing feet, and to enjoy ice skating the skates should properly fit the child's feet. Of course with growing feet, a new pair of skates must be purchased as the child's feet grow, sometimes on an annual basis.

There exists in the prior art boots that are modifiable in length. However, there does not exist in the prior art an ice skate that can be modified in length, and yet be durable, and also have a minimum number of parts to keep down costs and be easy for children to use. Thus, there is a need to provide an ice skate that can be modified in length, durable to the rigors that children put skates through and also be simple for children to use. The ice skate of the present invention being modifiable in length, durable and simple to use is advantageous especially for use by youth whose foot size may change significantly in a short period of time.

BRIEF SUMMARY OF THE INVENTION

The present invention comprises an ice skate that has a heel portion and a toe box portion which can be modifiable in length. The heel portion is disposed on a blade holder frame. The toe box portion is slidably disposed upon the blade holder frame and is slidable in relation to the heel portion. The toe box portion includes downwardly extending, resilient channel walls having detents disposed thereon which frictionally engage a plurality of indentations disposed upon the blade holder frame when the channel sidewalls are flexed inwardly and urged toward the blade holder frame.

DETAILED DESCRIPTION

Figure 1:
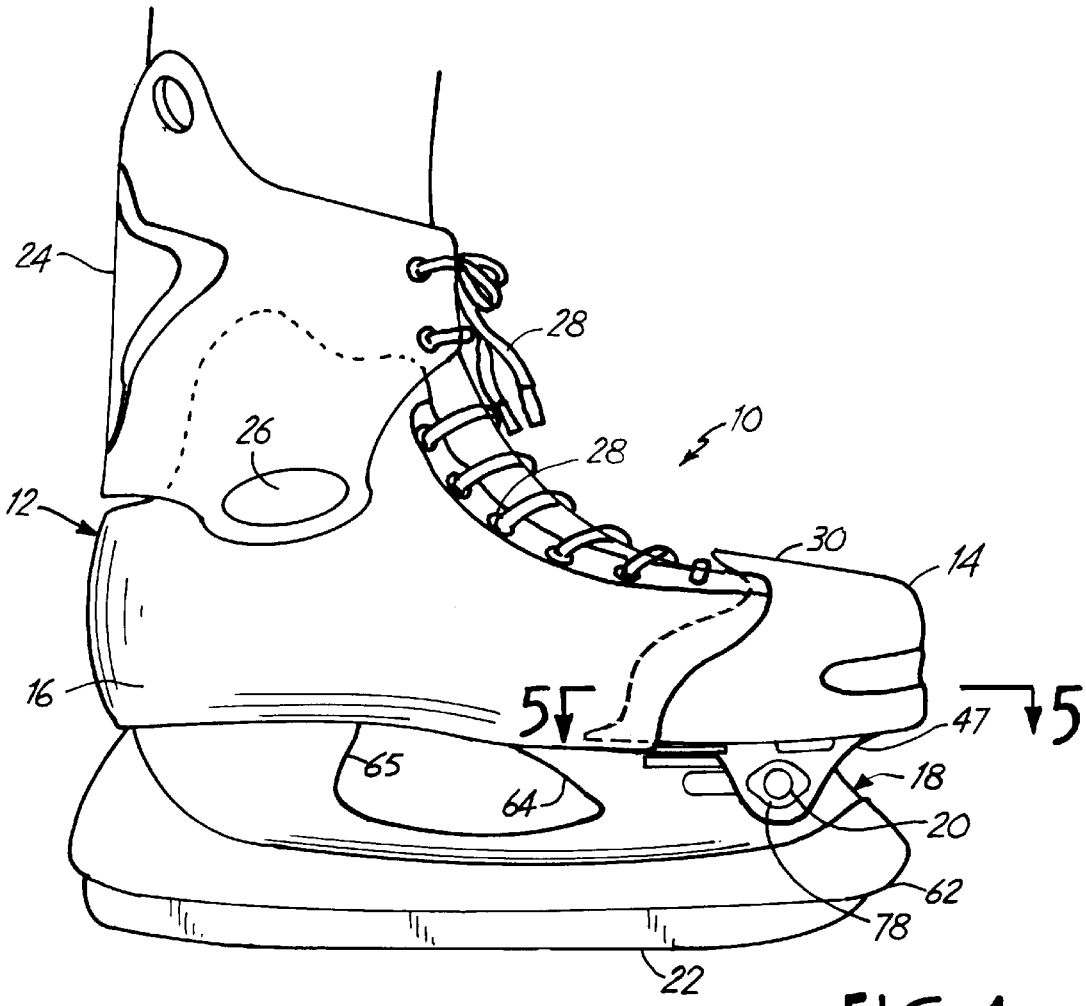
FIG. 1 is a side perspective view of the present invention.

The ice skate of the present invention is generally illustrated at 10 in FIG. 1. The ice skate 10 includes a boot 12 whose size may be modified in length. The boot 12 includes a toe box 14 and a heel portion 16 disposed on a blade holder frame 18. The toe box 14 slidably engages both the heel portion 16 and the blade holder frame 18. The toe box 14 is secured to the blade holder frame 18 by a locking mechanism 20. The blade holder frame 18 retains a blade 22 for engaging an ice surface, as is well known in the art. The boot 12 further includes a cuff portion 24 pivotally mounted to the heel portion 16 in a conventional manner by a pair of pivots 26 located on opposing sides of the cuff portion 24. Fastening means 28, including but not limited to laces and eyelets or adjustable straps, as are well known in the art, secure the cuff 24 to the leg and foot of a wearer. A suitable liner (not shown) has an elastic section proximate the toe box 14 so that the liner can accommodate different foot sizes. Such liners are known in the art.

Figure 2:
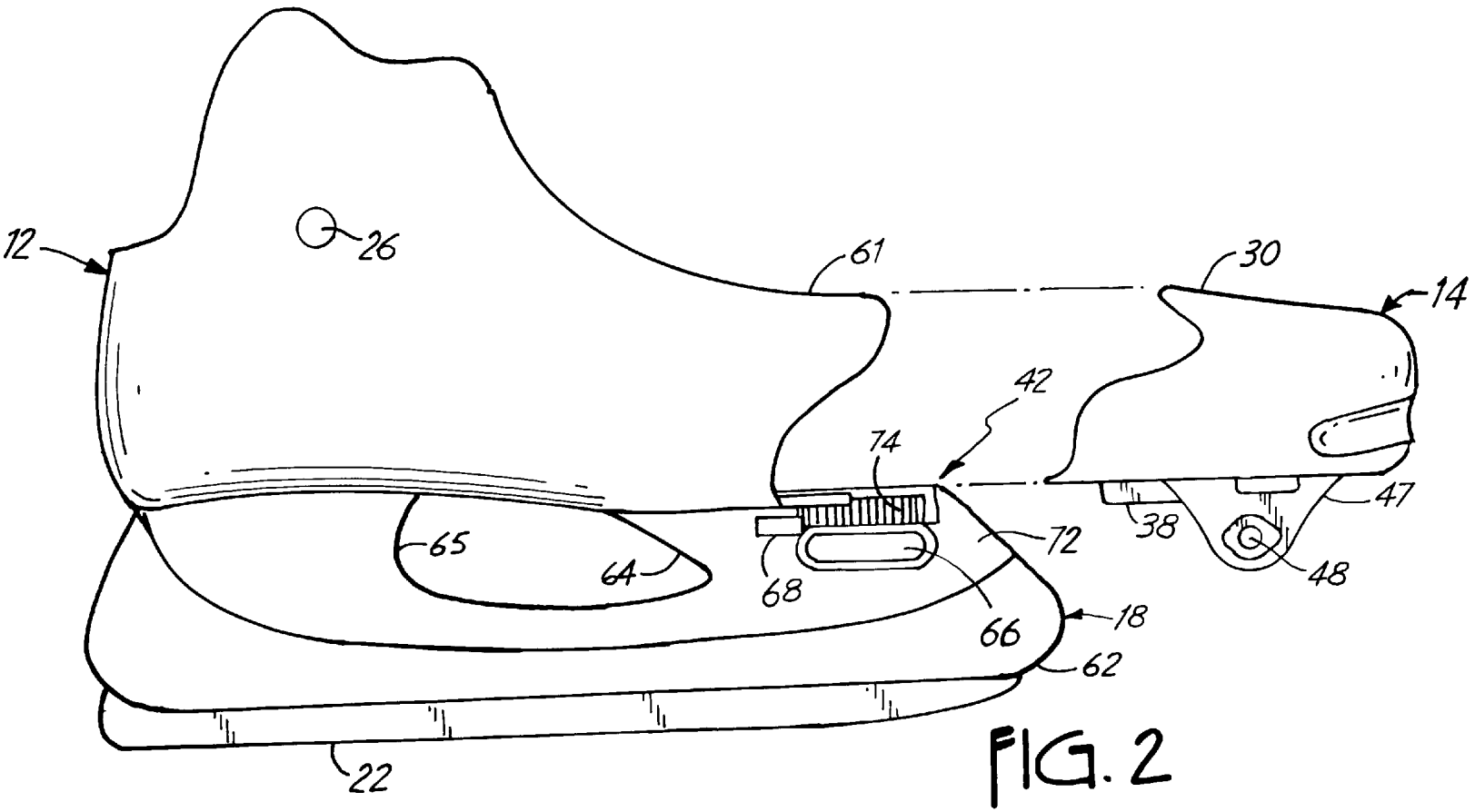
FIG. 2 is a side view of the present invention with a toe box portion removed.
Figure 3:
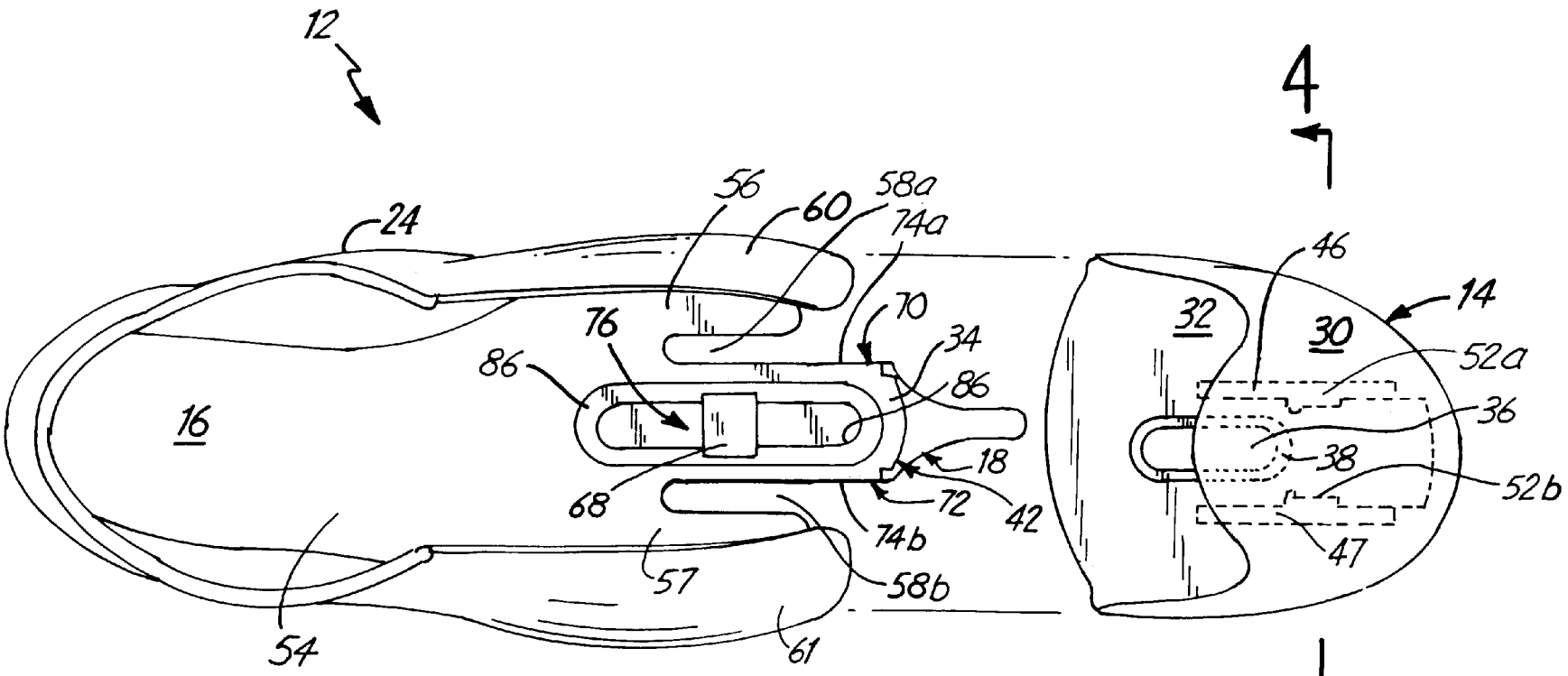
FIG. 3 is a top view of the present invention with the toe box portion removed.

As illustrated in FIGS. 2 and 3, the toe box 14 slidably attaches to the heel portion 16 and the blade holder frame 18, and is secured to the blade holder frame 18. The length of the ice skate 10 of the present invention is modified by moving the toe box 14 in relation to the heel portion 16 and blade holder frame 18 of the boot 12. The toe box 14 includes a forward toe cap portion 30 integrally formed with a toe sole portion 32. The toe sole portion 32 overlies a top forward surface 34 of the heel portion 16 and includes a first slot 36 positioned under the forward toe cap portion 30 along a longitudinal axis of the skate 10, as illustrated in FIG. 3. The first slot 36 includes a perimeter wall 38 extending downward below the surface of the toe sole portion 32.

Figure 4:
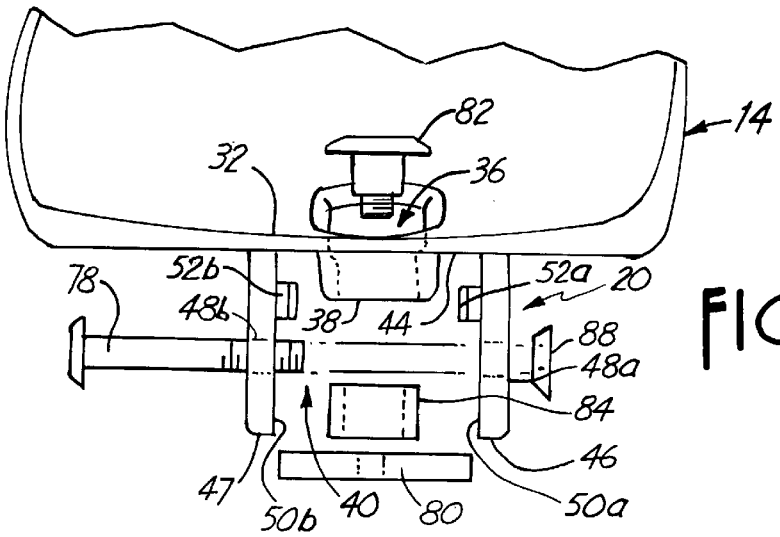
FIG. 4 is an exploded sectional view taken along line 4—4 in FIG. 3.

As illustrated in FIG. 4, the toe box 14 further includes a channel 40 for accepting a forward section 42 of the blade holder frame 18. The channel 40 is defined by a lower surface 44 of the toe sole portion 32 and downwardly extending, resilient left and right channel sidewalls 46 and 47. The left and right channel sidewalls 46 and 47 each include an aperture 48 and 49 positioned therethrough, and an inside surface 50*a* and 50*b* having detents 52*a* and 52*b* positioned thereon. Each detent 52*a* and 52*b* face opposite one another, and partly comprise the locking mechanism 20.

Figure 5:
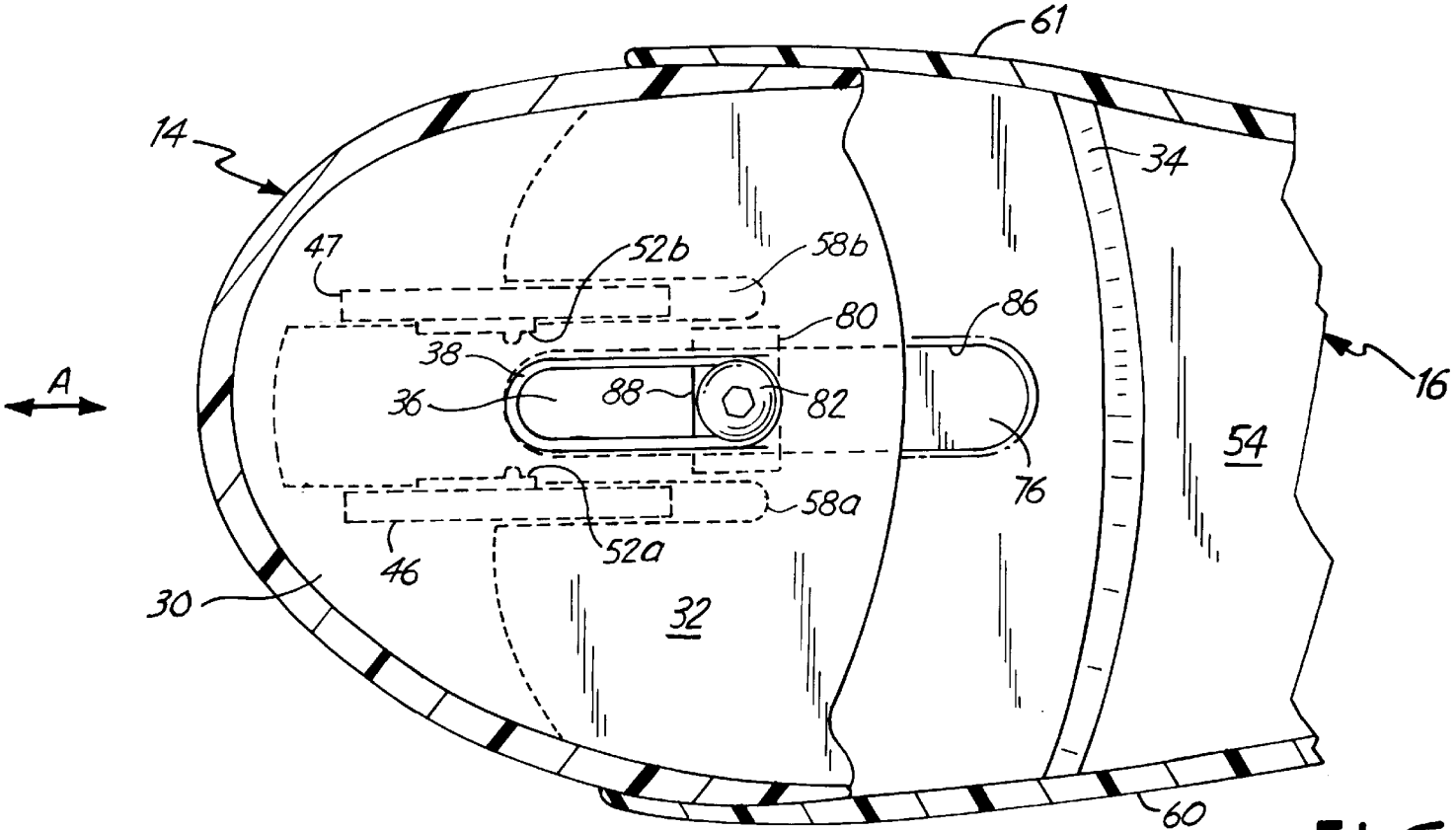
FIG. 5 a sectional view taken along the line 5—5 in FIG. 1.

The heel portion 16 includes a heel sole portion 54 and left and right quarters 56 and 57. The left and right quarters 56 and 57, each include elongated apertures 58*a* and 58*b* therethrough for partially receiving the left and right downwardly extending channel sidewalls 46 and 47, respectively, as best illustrated in FIG. 5. The heel sole portion 54 extends forwardly approximately to the instep of the foot. Left and right vamp sections 60 and 61 extend forward past the heel sole portion 54 and outside of the toe cap 30 of the toe box 14. It will be appreciated that the toe sole portion 32 and the heel sole portion 54 cooperate to form a single sole of the boot 12.

Figure 6:
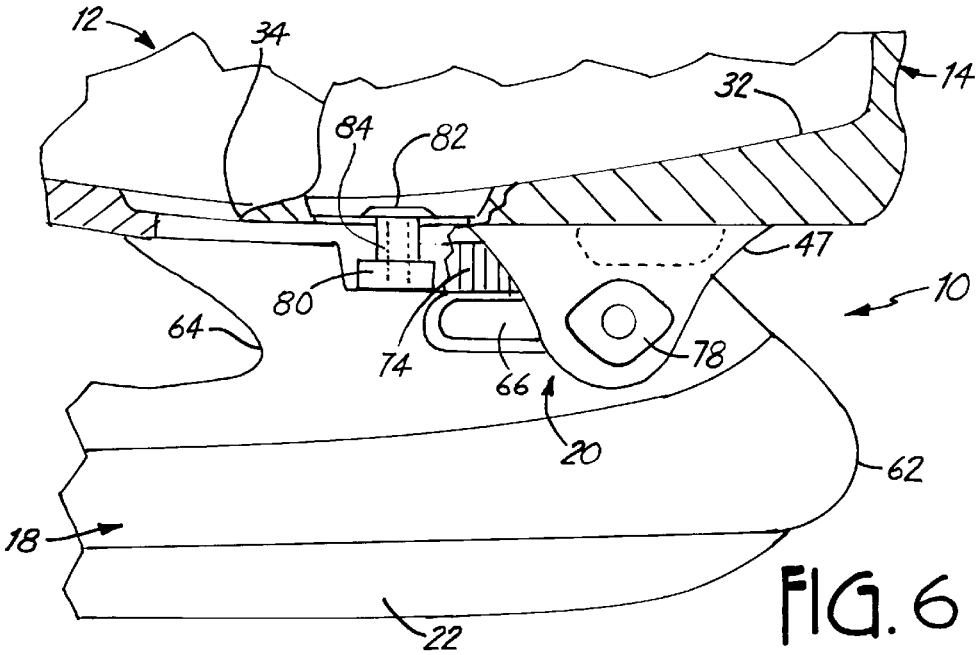
FIG. 6 is a partial sectional view of the present invention illustrating the toe box sole secured to a blade holder frame.

Referring now to FIGS. 2 and 3, the blade holder frame 18 comprises a blade receiving member 62 for receiving the blade 22, a front stanchion 64, and a back stanchion 65. Preferably, the heel portion 16 and the blade holder frame 18 are integrally formed. However, the heel portion 16 may be secured to the blade holder frame 18 by a variety of means including, but not limited to, riveting, bolting, gluing or stapling. The front stanchion 64 includes second slot 66 and a third slot 68 extending through the stanchion 64 from a first side surface 70 to a second side surface 72. The front stanchion 64 further includes a plurality of recessed indentations 74*a* and 74*b* positioned on each side surface 70 and 72, respectively. The front stanchion 64 even further includes a recessed surface 76 extending below the top forward surface 34 of the heel portion 16 and disposed longitudinally along the longitudinal axis of the skate 10. As illustrated in FIGS. 4 and 6, the second slot 66 receives a locking bolt 78, and is fashioned such that the bolt 78 may travel transversely in either longitudinal direction of the skate 10. The third slot 68 is fashioned to receive and retain a rectangular threaded bur 80 used for receiving a threaded securing bolt 82 to alignably secure the toe box 14 to the blade holder frame 18.

Securing the toe box to the front stanchion 64 of the blade holder frame 18 is the threaded securing screw 82, bushing 84 and the rectangular nut 80, as illustrated in FIG. 6. The first slot 36 of the toe box 14 is aligned with the recessed surface 76 of the front stanchion 64. The recessed surface 76 of the front stanchion 64 also includes guide wall surfaces 86 for slidably engaging the downwardly extending perimeter wall 38 of the toe box 14. The bushing 84 seats within the first slot 36 of the toe box 14, and the threaded securing screw 82 extends through the bushing 84 and threadably engages the rectangular nut 80. Upon threadably engaging the threaded securing screw 82 to the rectangular nut 80, the toe box 14 is slidably secured to the front stanchion 64 of the blade holder frame 18, and is allowed to travel in either longitudinal direction, as indicated by Arrow A, to extend or shorten the length of the boot 12.

The toe box 14 is locked into a selected position by the locking mechanism 20. The locking mechanism 20*a* includes the left and right downwardly extending channel walls 46 and 47 of the toe box 14 positioned proximate the sidewalls 70 and 72 of the front stanchion 64. The locking mechanism 20 further includes the locking bolt 78 extending through the apertures 48*a* and 48*b* of the downwardly extending channel walls 46 and 47 and the second slot 66 of the front stanchion 64. The downwardly extending channel walls 46 and 47 preferably have a natural tendency to flex or spring away from the sidewalls 70 and 72 of the front stanchion 64 of the blade holder frame 18 to an original or relaxed position. In the relaxed position, the detents 52*a* and 52*b* of the channel walls 46 and 47 do not engage the plurality of indentations 74 located on each surface 70 and 72 of the front stanchion 64. A locking nut 88 threadably engages the locking bolt 78, and upon tightening, the locking nut 88 and locking screw 78 urge and inwardly flex the downwardly extending channel walls 46 and 47 from the relaxed position and toward the sidewalls 70 and 72 of the front stanchion 64.

Upon urging and flexing the downwardly extending channel walls 46 and 47 toward the front stanchion 64, the detents 52*a* and 52*b* disposed upon the channel walls 46 and 47, respectively, cooperatively engage the plurality of indentations 74*a* and 74*b* disposed upon the side surfaces 70 and 72 of the front stanchion 64, thus locking the toe box 14 to the front stanchion 64 and heel portion 16 at a selected position. To position the toe box 14 in an alternative selected position, the locking screw 78 is un-tightened, allowing the channel walls 46 and 47 to flex outward 14 toward the relaxed position, thus causing the detents 52*a* and 52*b* to disengage from the plurality of indentations 74*a* and 74*b* and allowing the toe box 14 to slide in either longitudinal direction as indicated by Arrow A.

The location of the detents 52*a* and 52*b* and the indentations 74*a* and 74*b* may be reversed so that the detents 52*a* and 52*b* are located on sidewalls 70 and 72 and the indentations 74*a* and 74*b* are located on the left and right channel walls 46 and 47. Once the position of the to box 14 has been selected, the toe box 14 is secured in the selected position by tightening the screw 78 and the nut 88 which urges the left and right channel walls 46 and 47 against surfaces 70 and 72 of the front stanchion 64, thereby ensuring that detents 52*a* and 52*b* stay within the selected indentations 74*a* and 74*b*, all respectively.

Although the present invention has been described with reference to preferred embodiments, workers skilled in the art will recognize that changes may be made in form and detail without departing from the spirit and scope of the invention.

What is claimed is:

1. An ice skate comprising:

a blade holder frame for holding an ice engaging blade, the blade holder frame having a forward section;

a boot comprising a heel portion disposed on the blade holder frame and a toe box portion slidable on the forward section of the blade holder frame, the toe box portion having downwardly extending first and second channel walls;

wherein the forward section of the blade holder frame extends between the first and second channel walls; and wherein first and second detents disposed on either the forward section of the blade holder frame or the first and second channel walls engage a plurality of indentations disposed on either the forward section of the blade holder frame or the first and second channel walls to lock the toe box portion in a selected position and wherein the downwardly extending first and second channel walls are flexed from a relaxed position to an engaged position whereupon the first and second detents engage the plurality of indentations.

2. The ice skate of claim 1 and further comprising:

a first slot disposed within the toe box portion along a longitudinal axis of the skate, the slot having a perimeter wall extending downward; and a recessed surface to receive the perimeter wall of the first slot, the recessed surface disposed within the blade holder frame along the longitudinal axis of the skate, the perimeter wall and the recessed surface slidably engageable within one another such that the toe box portion may slide rearwardly or forwardly guided by the perimeter wall and the recessed surface.

3. The ice skate of claim 2 and further comprising:

a bushing insertable within the first slot;

a threaded screw insertable through the bushing;

a nut having a rectangular configuration to threadably engage the screw, the nut disposed with in the recessed surface; and wherein the threaded screw and bushing are positionable through the first slot to slidably secure the toe box to the blade holder frame.

4. The ice skate of claim 1 wherein the downwardly extending channel walls are resilient.

5. An ice skate comprising:

a blade holder frame having a forward section;

a boot disposed on the blade holder frame, the boot having a heel portion and a slidable toe box portion, the toe box portion having first and second downwardly extending channel walls, the forward section of the blade holder frame extending between the first and second channel walls;

first and second detents disposed on either the forward section of the blade holder frame or the first and second channel walls;

a plurality of indentations disposed on either the forward section of the blade holder frame or the first and second channel walls;

wherein the toe box is locked into a selected position upon the first and second detents engaging the plurality of indentations; and wherein the first and second detents engage the plurality of indentations upon flexing the first and second channel walls toward the forward section of the blade holder frame.

6. The ice skate of claim 5 wherein the heel portion comprises left and right vamp sections, the left and right vamp sections engaging an outside surface of the toe box portion.

7. The ice skate of claim 5 and further comprising;

a first slot disposed within the toe box portion along a longitudinal axis of the skate, the slot having a perimeter wall extending downward; and a recessed surface to receive the perimeter wall of the first slot, the recessed surface disposed longitudinally within the blade holder frame along the longitudinal axis of the skate, the first slot and the recessed surface slidably engageable with one another such that the toe box may slide rearwardly or forwardly guided by the perimeter wall.

8. The ice skate of claim 7 and further comprising:

a bushing;

a threaded screw insertable through the bushing;

a nut having a rectangular configuration to threadably engage the screw, the nut disposed within the recessed surface; and wherein the threaded screw and bushing are positionable through the first slot to slidably secure the toe box to the blade holder frame.

9. The ice skate of claim 5 wherein the blade holder frame includes a slotted aperture extending therethrough and the side channel walls include apertures alignable with the slotted aperture, and further including a locking member extending through the apertures of the side channel walls and the slotted aperture of the blade holder frame, the locking member flexing the side channel walls toward the forward section of the blade holder frame to engage the first and second detents with the plurality of indentations.

10. An ice skate comprising:

a blade holder frame for holding an ice engaging blade, the blade holder frame including a recessed surface disposed longitudinally along a longitudinal axis of the skate;

a boot comprising:

a heel portion disposed on the blade holder frame; and a toe box portion slidable on the blade holder frame, the toe box portion including a first slot disposed longitudinally along the longitudinal axis of the skate, the first slot including a perimeter wall extending downward;

wherein the perimeter wall of the toe box portion seats within the recessed surface of the blade holder frame to slidably guide the toe box portion rearwardly or forwardly to adjust the length of the boot; and wherein the locking mechanism comprising:

first and second channel members extending down from the toe box portion;

a forward section of the blade holder frame extendable between the first and second channel members;

first and second detents disposed on either the forward section of the blade holder frame or the first and second channel walls;

a plurality of indentations disposed on either the forward section of the blade holder frame or the first and second channel walls for engaging the first and second detents; and wherein the first and second detents engage the plurality of indentations upon flexing the first and second channel members toward the forward section of the blade holder frame to lock the toe box portion at a selected position.

11. The ice skate of claim 10 and further comprising:

a bushing positionable within the slot of the toe box portion;

a threaded screw insertable through the bushing;

a nut having a rectangular configuration to threadably engage the screw;

a second slot disposed within the blade holder frame to receive and retain the nut; and wherein the threaded screw secures the toe box portion to the blade holder frame upon threadably engaging the nut.

12. The ice skate of claim 10 wherein the first and second channel members are resiliently flexible from a first relaxed position to a second position whereupon the first and second detents engage the plurality of indentations.

13. The ice skate of claim 10 wherein the locking mechanism further comprises:

a surface defining a slotted aperture extending through the blade holder frame;

a first surface defining an aperture through the first channel wall;

a second surface defining an aperture through the second channel wall;

a locking member insertable through the slotted aperture of the blade holder frame, the aperture of the first channel wall and the aperture of the second channel wall; and wherein the locking member urges the first and second channel walls toward the forward section of the blade holder frame to engage the first and second detents with the plurality of indentations.

14. The ice skate of claim 13 and further comprising:

a bushing positionable within the slot of the toe box portion;

a threaded screw insertable through the bushing;

a nut having a rectangular configuration to threadably engage the screw;

a second slot disposed within the blade holder frame to receive and retain the nut; and wherein the threaded screw secures the toe box portion to the blade holder frame upon threadably engaging the nut.

15. The ice skate of claim 10 wherein the heel portion comprises a left vamp section and a right vamp section, the left and right vamp sections positionable over an outside surface of the toe box portion.

16. An ice skate comprising:

a blade holder frame having a forward section;

a boot disposed on the blade holder frame, the boot having a heel portion and a slidable toe box portion, the toe box portion having first and second downwardly extending channel walls, the forward section of the blade holder frame extending between the first and second channel walls;

first and second detents disposed on either the forward section of the blade holder frame or the first and second channel walls;

a plurality of indentations disposed on either the forward section of the blade holder frame or the first and second channel walls;

wherein the toe box is locked into a selected position upon the first and second detents engaging the plurality of indentations; and wherein the first and second channel walls are resilient and are positionable between a relaxed position and a position whereupon the first and second detents engage the plurality of indentations.

17. The ice skate of claim 16 wherein the heel portion comprises left and right vamp sections, the left and right vamp sections engaging an outside surface of the toe box portion.

18. The ice skate of claim 16 and further comprising;

a first slot disposed within the toe box portion along a longitudinal axis of the skate, the slot having a perimeter wall extending downward; and a recessed surface to receive the perimeter wall of the first slot, the recessed surface disposed longitudinally within the blade holder frame along the longitudinal axis of the skate, the first slot and the recessed surface slidably engageable with one another such that the toe box may slide rearwardly or forwardly guided by the perimeter wall.

19. The ice skate of claim 18 and further comprising:

a bushing;

a threaded screw insertable through the bushing;

a nut having a rectangular configuration to threadably engage the screw, the nut disposed within the recessed surface; and wherein the threaded screw and bushing are positionable through the first slot to slidably secure the toe box to the blade holder frame.

20. The ice skate of claim 16 wherein the blade holder frame includes a slotted aperture extending therethrough and the side channel walls include apertures alignable with the slotted aperture, and further including a locking member extending through the apertures of the side channel walls and the slotted aperture of the blade holder frame, the locking member flexing the side channel walls toward the forward section of the blade holder frame to engage the first and second detents with the plurality of indentations.

21. An ice skate comprising:

a blade holder frame having a forward section;

a boot disposed on the blade holder frame, the boot having a heel portion and a slidable toe box portion, the toe box portion having first and second downwardly extending channel walls, the forward section of the blade holder frame extending between the first and second channel walls;

first and second detents disposed on either the forward section of the blade holder frame or the first and second channel walls;

a plurality of indentations disposed on either the forward section of the blade holder frame or the first and second channel walls;

wherein the toe box is locked into a selected position upon the first and second detents engaging the plurality of indentations; and wherein the heel portion comprises left and right vamp sections, the left and right vamp sections engaging an outside surface of the toe box portion.

22. The ice skate of claim 21 and further comprising;

a first slot disposed within the toe box portion along a longitudinal axis of the skate, the slot having a perimeter wall extending downward; and a recessed surface to receive the perimeter wall of the first slot, the recessed surface disposed longitudinally within the blade holder frame along the longitudinal axis of the skate, the first slot and the recessed surface slidably engageable with one another such that the toe box may slide rearwardly or forwardly guided by the perimeter wall.

23. The ice skate of claim 22 and further comprising:

a bushing;

a threaded screw insertable through the bushing;

a nut having a rectangular configuration to threadably engage the screw, the nut disposed within the recessed surface; and wherein the threaded screw and bushing are positionable through the first slot to slidably secure the toe box to the blade holder frame.

24. The ice skate of claim 21 wherein the blade holder frame includes a slotted aperture extending therethrough and the side channel walls include apertures alignable with the slotted aperture, and further including a locking member extending through the apertures of the side channel walls and the slotted aperture of the blade holder frame, the locking member flexing the side channel walls toward the forward section of the blade holder frame to engage the first and second detents with the plurality of indentations.

25. An ice skate comprising:

a blade holder frame having a forward section;

a boot disposed on the blade holder frame, the boot having a heel portion and a slidable toe box portion, the toe box portion having first and second downwardly extending channel walls, the forward section of the blade holder frame extending between the first and second channel walls;

first and second detents disposed on either the forward section of the blade holder frame or the first and second channel walls;

a plurality of indentations disposed on either the forward section of the blade holder frame or the first and second channel walls;

wherein the toe box is locked into a selected position upon the first and second detents engaging the plurality of indentations; and further comprising:

a first slot disposed within the toe box portion along a longitudinal axis of the skate, the slot having a perimeter wall extending downward; and a recessed surface to receive the perimeter wall of the first slot, the recessed surface disposed longitudinally within the blade holder frame along the longitudinal axis of the skate, the first slot and the recessed surface slidably engageable with one another such that the toe box may slide rearwardly or forwardly guided by the perimeter wall.

26. The ice skate of claim 25 and further comprising:

a bushing;

a threaded screw insertable through the bushing;

a nut having a rectangular configuration to threadably engage the screw, the nut disposed within the recessed surface; and wherein the threaded screw and bushing are positionable through the first slot to slidably secure the toe box to the blade holder frame.

27. The ice skate of claim 25 wherein the blade holder frame includes a slotted aperture extending therethrough and the side channel walls include apertures alignable with the slotted aperture, and further including a locking member extending through the apertures of the side channel walls and the slotted aperture of the blade holder frame, the locking member flexing the side channel walls toward the forward section of the blade holder frame to engage the first and second detents with the plurality of indentations.

28. An ice skate comprising:

a blade holder frame having a forward section;

a boot disposed on the blade holder frame, the boot having a heel portion and a slidable toe box portion, the toe box portion having first and second downwardly extending channel walls, the forward section of the blade holder frame extending between the first and second channel walls;

first and second detents disposed on either the forward section of the blade holder frame or the first and second channel walls;

a plurality of indentations disposed on either the forward section of the blade holder frame or the first and second channel walls;

wherein the toe box is locked into a selected position upon the first and second detents engaging the plurality of indentations; and wherein the blade holder frame includes a slotted aperture extending therethrough and the side channel walls include apertures alignable with the slotted aperture, and further including a locking member extending through the apertures of the side channel walls and the slotted aperture of the blade holder frame, the locking member flexing the side channel walls toward the forward section of the blade holder frame to engage the first and second detents with the plurality of indentations.

* * * * *